US010496002B2

(12) United States Patent
Sakuraba et al.

(10) Patent No.: US 10,496,002 B2
(45) Date of Patent: Dec. 3, 2019

(54) IMAGE FORMING APPARATUS AND CONTROL METHOD FOR CONTROLLING PHOTOCONDUCTOR FILM THICKNESS DETECTION

(71) Applicants: Jyunya Sakuraba, Kanagawa (JP); Shinji Minami, Kanagawa (JP)

(72) Inventors: Jyunya Sakuraba, Kanagawa (JP); Shinji Minami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/249,113

(22) Filed: Jan. 16, 2019

(65) Prior Publication Data

US 2019/0286004 A1 Sep. 19, 2019

(30) Foreign Application Priority Data

Mar. 15, 2018 (JP) ..... 2018-048516

(51) Int. Cl.
*G03G 15/00* (2006.01)
*G03G 15/02* (2006.01)

(52) U.S. Cl.
CPC ..... *G03G 15/0266* (2013.01); *G03G 15/75* (2013.01)

(58) Field of Classification Search
CPC ..... G03G 15/75; G03G 15/751
USPC ..... 399/26, 48
See application file for complete search history.

(56) References Cited

U.S. PATENT DOCUMENTS 7,783,212 B2 * 8/2010 Ichikawa et al. ..... G01B 7/06 399/26
7,826,754 B2 * 11/2010 Kurita et al. ..... G03G 15/5037 399/26
7,831,157 B2 * 11/2010 Yamaguchi et al. ..... G03G 15/0216 399/26
2012/0207495 A1 8/2012 Sakuraba et al.
2015/0093137 A1 4/2015 Minami
2015/0139674 A1 5/2015 Sugiyama et al.
2016/0109832 A1 4/2016 Ohsugi et al.
(Continued)

FOREIGN PATENT DOCUMENTS

JP 2005-164852 6/2005
JP 2006-309144 11/2006
(Continued)

*Primary Examiner* — William J Royer
(74) *Attorney, Agent, or Firm* — Harness, Dickey & Pierce, P.L.C.

(57) ABSTRACT

An image forming apparatus includes a photoconductor, a power supply, and circuitry. The power supply is configured to apply a charging voltage to the photoconductor. The circuitry is configured to control film thickness detection of detecting a charging current corresponding to the charging voltage to detect a film thickness of a surface of the photoconductor. The circuitry is further configured to determine a sampling period taken to detect the charging current; calculate a variation in the charging current detected; and determine whether the variation is greater than a threshold. The circuitry is configured to: determine the sampling period according to a determination result as to whether the variation is greater than the threshold; and sample the charging current for the sampling period determined, on a subsequent film thickness detection control.

12 Claims, 6 Drawing Sheets

(56) References Cited

U.S. PATENT DOCUMENTS

| | | | |
|---|---|---|---|
| 2017/0003630 | A1 | 1/2017 | Ohsugi et al. |
| 2017/0023904 | A1 | 1/2017 | Hakamada et al. |
| 2017/0255122 | A1 | 9/2017 | Minami |
| 2017/0329263 | A1 | 11/2017 | Sugiura et al. |
| 2018/0217546 | A1 | 8/2018 | Nagamatsu |

FOREIGN PATENT DOCUMENTS

| | | |
|---|---|---|
| JP | 2007-183475 | 7/2007 |
| JP | 2010-091797 | 4/2010 |
| JP | 2012-083541 | 4/2012 |
| JP | 2013-142749 | 7/2013 |
| JP | 2013-156537 | 8/2013 |
| JP | 2013-257534 | 12/2013 |
| JP | 2016-081013 | 5/2016 |
| JP | 2017-049499 | 3/2017 |
| JP | 2018-124454 | 8/2018 |

* cited by examiner

IMAGE FORMING APPARATUS AND CONTROL METHOD FOR CONTROLLING PHOTOCONDUCTOR FILM THICKNESS DETECTION

CROSS-REFERENCE TO RELATED APPLICATIONS

This patent application is based on and claims priority pursuant to 35 U.S.C. § 119(a) to Japanese Patent Application No. 2018-048516, filed on Mar. 15, 2018, in the Japan Patent Office, the entire disclosure of which is hereby incorporated by reference herein.

BACKGROUND

Technical Field

Embodiments of the present disclosure relate to an image forming apparatus and a control method employed by the image forming apparatus.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

In such image forming apparatuses, the charging performance (or charging capacity) of the photoconductor is one of the main factors to form a high-quality image.

SUMMARY

In one embodiment of the present disclosure, a novel image forming apparatus includes a photoconductor, a power supply, and circuitry. The power supply is configured to apply a charging voltage to the photoconductor. The circuitry is configured to control film thickness detection of detecting a charging current corresponding to the charging voltage to detect a film thickness of a surface of the photoconductor. The circuitry is further configured to determine a sampling period taken to detect the charging current; calculate a variation in the charging current detected; and determine whether the variation is greater than a threshold. The circuitry is configured to: determine the sampling period according to a determination result as to whether the variation is greater than the threshold; and sample the charging current for the sampling period determined, on a subsequent film thickness detection control.

Also described is a control method employed by the image forming apparatus.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
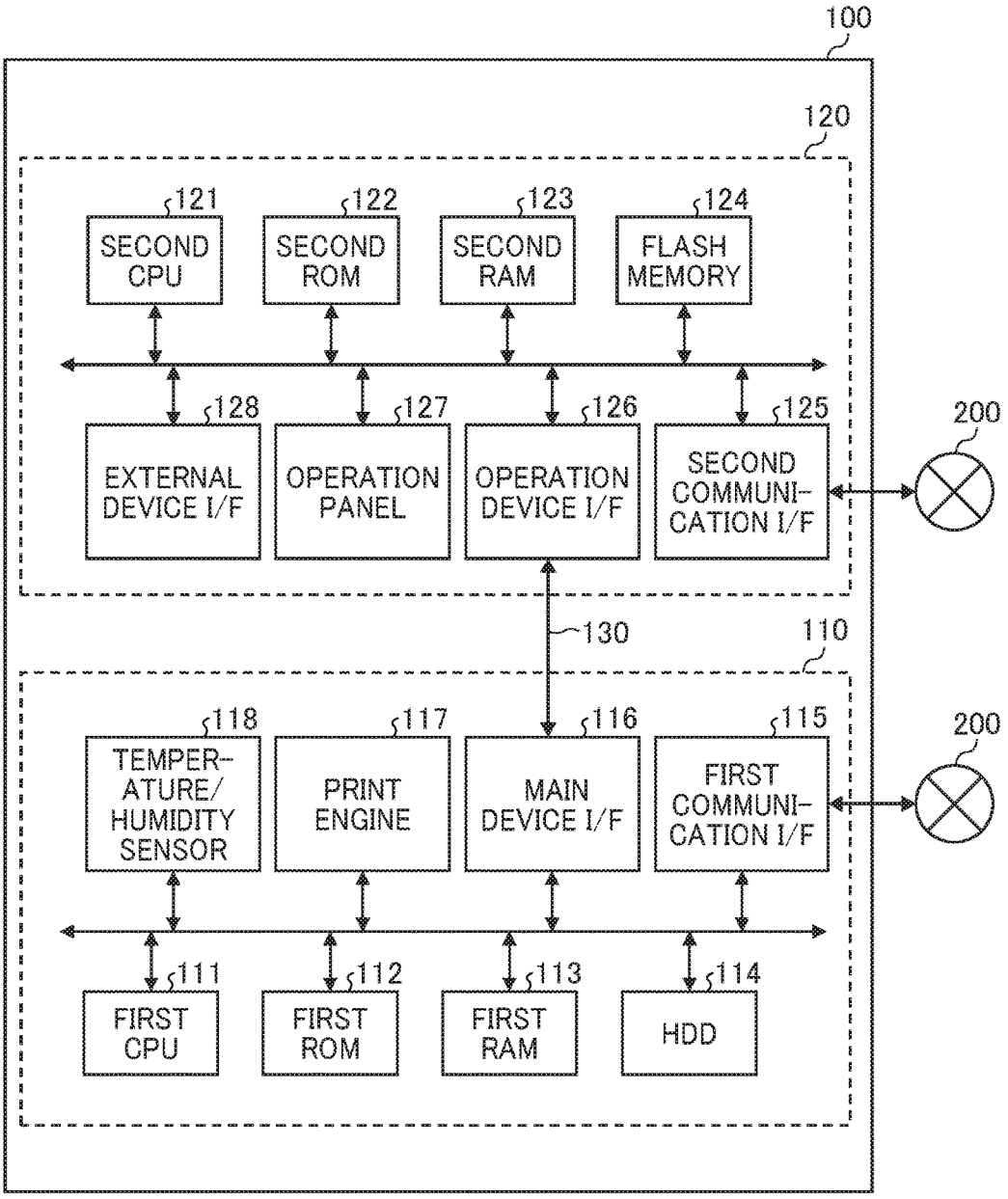
FIG. 1 is a block diagram illustrating a hardware configuration of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring to the drawings, wherein like reference numerals designate identical or corresponding parts throughout the several views, embodiments of the present disclosure are described below.

Initially with reference to FIG. 1, a description is given of a hardware configuration of an age forming apparatus according to an embodiment of the present disclosure.

According to an embodiment, the image forming apparatus controls detection of the film thickness of an image bearer (e.g., a photoconductor) included in the image forming apparatus, based on a charging current value. Specifically, the image forming apparatus determines a sampling period taken to sample a charging current on a subsequent control, according to how much detected charging current varies.

In the present embodiment, the image forming apparatus is a multifunction peripheral (MFP) 100 having at least two of printing, scanning, copying, and facsimile functions.

FIG. 1 is a block diagram illustrating a hardware configuration of the MFP 100.

The MFP 100 is an example of a digital MFP that combines the printing, scanning, copying, and facsimile functions into a single housing. The MFP 100 includes a main device 110, serving as a first device, and an operation device 120, serving as a second device. The main device 110 is combined with the operation device 120. The main device 110 and the operation device 120 are connected to each other through an interface cable 130.

The main device 110 includes a first central processing unit (CPU) 111, a first read only memory (ROM) 112, a first random access memory (RAM) 113, a hard disk drive (HDD) 114, a first communication interface (I/F) 115, a main device I/F 116, a print engine 117, and a temperature/humidity sensor 118. The hardware components described above are connected to each other via a common bus in the main device 110.

The first CPU 111 functions as a central processing unit that controls an overall operation of the MFP 100. The first CPU 111, having an arithmetic processing function, executes a control program according to the present embodiment, thereby causing substantial functions and a control method of the present embodiment implementable; a detailed description thereof is deferred.

The first ROM 112 is a nonvolatile storage medium that stores, in advance, a control program that is executed by the first CPU 111 and information that is used for the control program, for example.

The first RAM 113 functions as a work area for the first CPU 111 to execute the control program. Whereas, the first RAM 113 is a storage medium that stores a model value corresponding to initialization processing of the MFP 100 and an application program for execution of the initialization processing. The application program is downloaded via a communication network 200, for example. The first RAM 113 also functions as a work area for the print engine 117 to execute an image forming process.

The HDD 114 is a storage medium that stores, in advance, a control program that is executed by the first CPU 111 and information that is used for the control program, for example. Whereas, the HDD 114 is a storage medium that temporarily stores a job according to which the print engine 117 executes image processing.

The first communication I/F 115 is an interface that connects the main device 110 to the communication network 200 such as a local area network (LAN).

The main device I/F 116 is an interface that communicably connects the main device 110 to the operation device 120. The main device DT 116 functions as a communication interface to exchange data with the operation device 120, so that the main device 110 performs processing with the data received from the operation device 120; whereas the operation device 120 performs processing with the data received from the main device 110.

The print engine 117 executes processing based on instruction data (or a print job) instructing the details of the image forming process. The instruction data (or print job) is transmitted via the communication network 200 or the interface cable 130 between the main device 110 and the operation device 120, for example. The processing executed by the print engine 117 specifies, e.g., the amount and details of image formation instructed by the print job. The amount of image formation is, e.g., the number of sheets (or the number of pages) to be printed in a printing process. Examples of the details of image formation include text-only printing, image printing (or printing of targets including images), distinguishing between monochrome and color, distinguishing between a halftone, text, a photograph, and a solid image. The print job includes pixel information and print conditions described above. The influence on the film thickness of a photoconductor 142, described below, depends on the print conditions and the pixel information. Therefore, the print engine 117 notifies the first CPU 111 of the "print conditions" and the "pixel information" based on the print job.

The temperature/humidity sensor 118 is disposed inside the housing of the MFP 100 to measure the temperature and humidity inside the housing of the MFP 100 and output temperature and humidity information. Although the temperature/humidity sensor 118 is ideally disposed near the photoconductor 142 and a charging roller 143, the temperature/humidity sensor 118 may be disposed apart from, e.g., the photoconductor 142 due to a limited installation space. Note that a detailed description of the photoconductor 142 and the charging roller 143 is deferred.

The operation device 120 includes a second CPU 121, a second ROM 122, a second RAM 123, a flash memory 124 as a nonvolatile memory, a second communication 125, an operation device I/F 126, an operation panel 127, and an external device I/F 128. The hardware components described above are connected to each other via a common bus in the operation device 120.

The second CPU 121 functions as a central processing unit that controls operation of the operation device 120.

The second ROM 122 is a nonvolatile storage medium that stores, in advance, a control program that is executed by the second CPU 121 and information that is used for the control program, for example.

The second RAM 12.3 is a storage medium that stores a model type value corresponding to different initialization processing details. Execution of the initialization processing installs application software on the second RAM 123.

The flash memory 124, as a nonvolatile memory, is a storage medium that stores, e.g., setting data that is used for a given operation process.

The second communication I/F 125 is an interface that connects the operation device 120 to the communication network 200 such as a LAN.

The operation device I/F 126 is connected to the main device I/F 116 via the interface cable 130 such that the main device I/F 116 and the operation device I/F 126 communicate to each other via the interface cable 130.

The operation panel 127 provides a user interface for, e.g., a user who uses the MFP 100. Whereas, the operation panel 127 functions as an operation input device that accepts or receives an instruction from the user.

The external device I/F 128 is an interface that connects an external device (e.g., an information processing device) to the MFP 100.

In one embodiment, each of the main device I/F 116 and the operation device I/F 126 may have a wireless communication function. In such a case, the operation device 120 may be detached from the main device 110, as a separate device from the main device 110 without connection via the interface cable 130.

Note that FIG. 1 illustrates the MFP 100 in which the operation device 120 is attached to the main device 110. On the other hand, an image forming system includes the main device 110 and the operation device 120 before the operation device 120 is attached to the main device 110. That is, since the MFP 100 is an example of an information processing apparatus, the MFP 100 may be also regarded as an information processing system.

Figure 2:
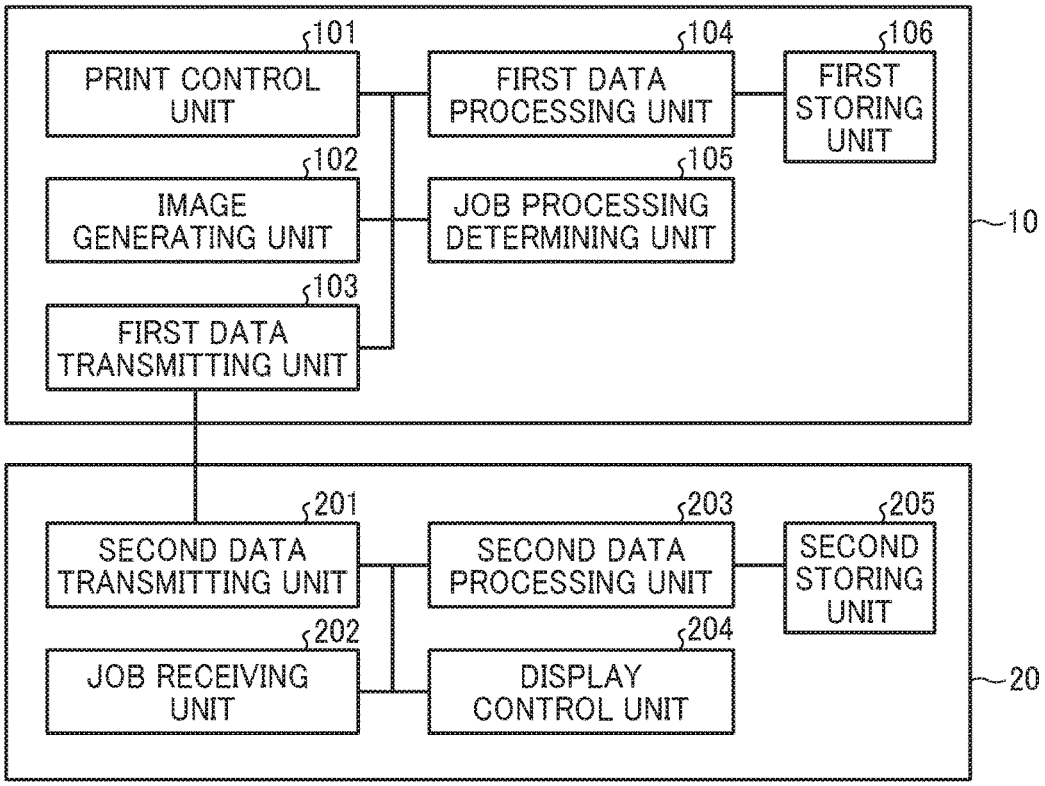
FIG. 2 is a functional block diagram illustrating a functional configuration of the image forming apparatus.

Referring now to FIG. 2, a description is given of a functional configuration of the MFP 100 for implementing overall processing of the MFP 100 described above.

FIG. 2 is a functional block diagram illustrating an example of the functional configuration of the MFP 100.

In FIG. 2, the MFP 100 includes a first controller 10 and a second controller 20. The first controller 10 includes control functions of the main device 110; whereas the second controller 20 includes control functions of the operation device 120. The first controller 10 and the second controller 20 send and receive, e.g., data to and from each other, thereby implementing functions of the MFP 100.

The first controller 10 includes a print control unit 101, an image generating unit 102, a first data transmitting unit 103, a first data processing unit 104, a job processing determining unit 105, and a first storing unit 106.

A first data transmitting unit 103 is implemented by the main device I/F 116. The first data transmitting unit 103 sends and receives various kinds of data (or information) to and from the operation device 120 through universal serial bus (USB) communication.

The image generating unit 102 is implemented by a command from the first CPU 111, a controller program stored in the first ROM 112, and the first RAM 113. The image generating unit 102 loads a print job from, e.g., a user, executes given image processing, generates print data, and stores the print data in the first RAM 113.

The first data processing unit 104 is implemented by a command from the first CPU 111 and a controller program stored in the first ROM 112. The first data processing unit 104 stores various kinds of data in the first storing unit 106. The first data processing unit 104 also retrieves the various kinds of data from the first storing unit 106.

The print control unit 101 is implemented by a command from the first CPU 111, a controller program stored in the first ROM 112, the print engine 117, and the main device I/F 116. The print control unit 101 causes the print engine 117 to transfer, onto a recording medium, an image drawn on the first RAM 113 by the image generating unit 102. Thus, the image is formed on the recording medium.

The job processing determining unit 105 is implemented by a command from the first CPU 111, a controller program stored in the first ROM 112, and the main device I/F 116. Upon activation of the first controller 10, the job processing determining unit 105 acquires a tray information management table from the first storing unit 106. In response to a job processing request transmitted by the operation device 120, the job processing determining unit 105 extracts, from the tray information management table, print setting information associated with a tray number designated by the job processing request.

Image forming condition information of the job processing request accompanies print setting information and print editing conditions, together with information for requesting job processing. The print setting information includes, e.g., the size and orientation of a recording medium. The print editing conditions include, e.g., duplex or simplex printing and whether to print two pages on one side of paper.

The job processing determining unit 105 determines whether the print setting information (e.g., the size and orientation of a recording medium) extracted from the tray information management table matches the print setting information (e.g., the size and orientation of a recording medium) accompanied with the job processing request. When the print setting information extracted from the tray information management table matches the print setting information accompanied with the job processing request, the job processing determining unit 105 requests the print control unit 101 to execute processing according to the image forming condition information of the job processing request. On the other hand, when the print setting information extracted from the tray information management table does not match the print setting information accompanied with the job processing request, the job processing determining unit 105 determines to cancel a job requested by the job processing request. When the job processing determining unit 105 determines to cancel the job, the job processing determining unit 105 transmits information indicating cancellation of the job to the second controller 20 via the first data transmitting unit 103.

The second controller 20 includes a second data transmitting unit 201, a job receiving unit 202, a second data processing unit 203, a display control unit 204, and a second storing unit 205. The components described above are functions or means that are implemented by operation of any of the components illustrated in FIG. 1 following a command from the second CPU 121 according to an operation device program stored in the second ROM 122. As described above, the second controller 20 includes the second storing unit 205. The second storing unit 205 is implemented by the flash memory 124, as a nonvolatile memory, illustrated in FIG. 1. The second storing unit 205 stores a tray information management table.

The second data transmitting unit 201 is implemented by the operation device I/F 126. The second data transmitting unit 201 sends and receives various kinds of data (or information) to and from the first controller 10 through USB communication.

The second data processing unit 203 is executed by a command from the second CPU 121 illustrated in FIG. 1. The second data processing unit 203 stores various kinds of data in the second storing unit 205. The second data processing unit 203 also retrieves the various kinds of data from the second storing unit 205.

The display control unit 204 is implemented by a command from the second CPU 121 and an operation device program stored in the second ROM 122. The display control unit 204 controls image display on a screen of the operation panel 127. The display control unit 204 also inputs, to the job receiving unit 202, operation information created by an operation performed by, e.g., a user on the screen of the operation panel 127. For example, the display control unit 204 inputs, to the job receiving unit 202, a job processing request created by an operation, performed by a user, requesting job processing such as printing. Specifically, the user inputs the job processing request based on the tray information management table stored in the second storing unit 205. In a case in which the display control unit 204 receives, from the job receiving unit 202, information indicating that the job processing is canceled, as a response to the job processing request, the display control unit 204 displays that the job is canceled on the screen of the operation panel 127.

The job receiving unit 202 is implemented by a command from the second CPU 121 and an operation device program stored in the second ROM 122. When the job receiving unit 202 receives a job processing request from the display control unit 204, the job receiving unit 202 transmits the job processing request to the first controller 10 via the second data transmitting unit 201. In a case in which, as a response to the job processing request, the job receiving unit 202 receives information indicating cancellation of the job processing from the first controller 10 via the second data transmitting unit 201, the job receiving unit 202 causes the display control unit 204 to display that the job processing is canceled.

The functional configuration described above with reference to the block diagram of FIG. 2 are implemented by programs (e.g., controller program, operation device program) that are executed in the MFP 100. The programs may be recorded on a computer-readable recording or storage medium such as a compact disc read-only memory (CD-ROM), a flexible disk (FD), a compact disc recordable (CD-R), a digital versatile or digital video disk (DVD), or a USB in a file in installable or executable format. Thus, the computer-readable recording or storage medium recording or storing the programs may be provided.

Alternatively, the programs may be provided or distributed via a network such as the Internet. A target program may be stored in a nonvolatile recording or storage medium in advance. Thus, the nonvolatile recording or storage medium recording or storing the target program may be provided.

Figure 3:
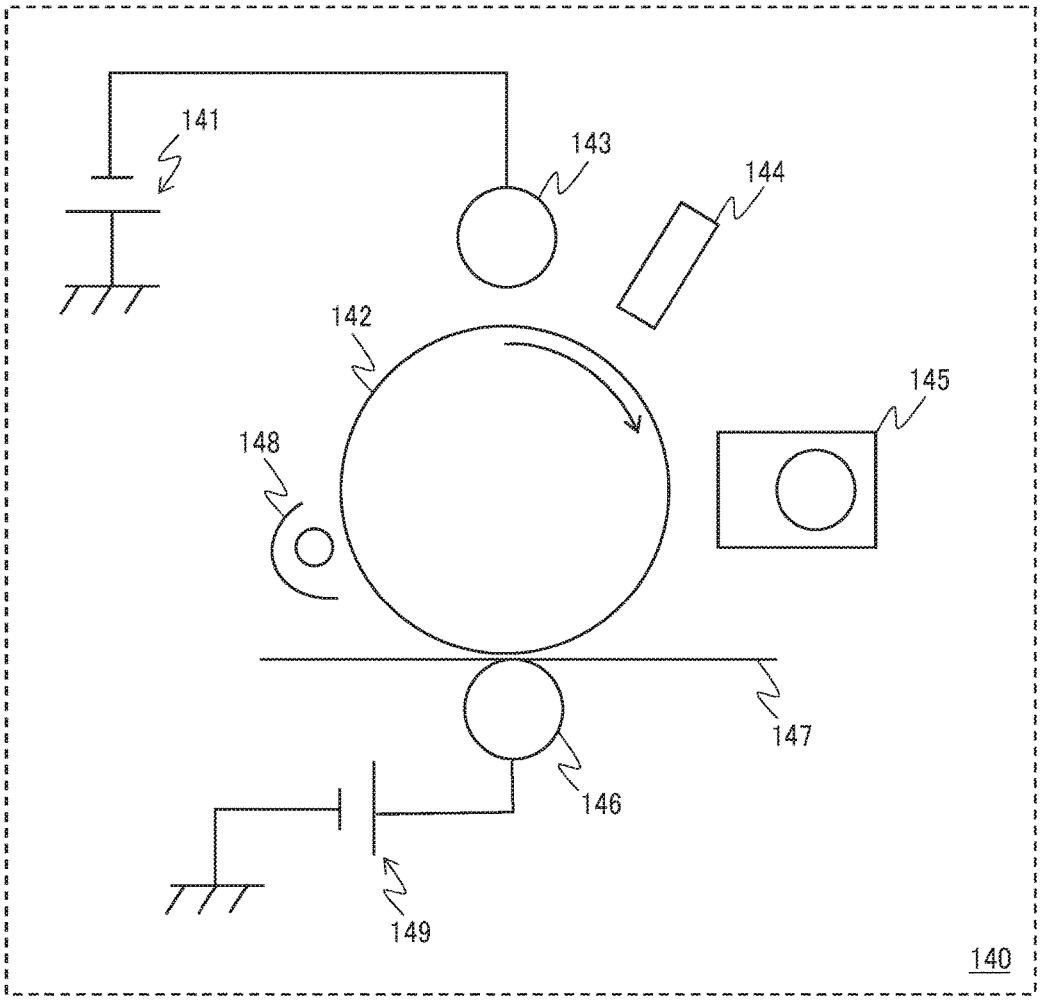
FIG. 3 is a schematic view of an image forming device incorporated in the image forming apparatus.

Referring now to FIG. 3, a description is given of a detailed configuration of an image forming device 140, which is one of the main portions of the print engine 117 used in an image forming process of an electrophotographic method employed by the MFP 100 described above.

FIG. 3 is a schematic view of the image forming device 140 incorporated in the MFP 100.

As illustrated in FIG. 3, the image forming device 140 incorporated in the print engine 117 of the MFP 100 includes, a charging high-voltage power supply 141, the charging roller 143, and the photoconductor 142. The charging high-voltage power supply 141 is a charging power supply that supplies high-voltage electric power for charging. The charging high-voltage power supply 141 supplies electric power to apply voltage to the charging roller 143. Thus, the charging roller 143 is charged with an applied voltage. The photoconductor 142 serves as an image formation medium or image bearer to be charged via the charging roller 143. The image forming device 140 also includes an exposure device 144, a developing device 145, and a primary-transfer high-voltage power supply 149. The exposure device 144 exposes the surface of the photoconductor 142 according to an image signal to form an electrostatic latent image on the surface of the photoconductor 142. The developing device 145 develops the electrostatic latent image into a visible toner image on the surface of the photoconductor 142. The primary-transfer high-voltage power supply 149 supplies high-voltage electric power for primary transfer.

The image forming device 140 further includes a primary transfer roller 146, an intermediate belt 147, and a neutralizer 148. The primary-transfer high-voltage power supply 149 supplies high-voltage electric power to apply a high voltage to the primary transfer roller 146. The toner image is transferred from the surface of the photoconductor 142 onto the intermediate belt 147. The neutralizer 148 removes charges from the surface of the photoconductor 142.

In the image forming device 140, the charging high-voltage power supply 141 supplies high-voltage electric power, thereby generating and applying a high voltage to the charging roller 143. The charging roller 143 uniformly charges the surface of the photoconductor 142. Thereafter, the exposure device 144 exposes the surface of the photoconductor 142 according to an image signal, thereby forming an electrostatic latent image on the surface of the photoconductor 142. The developing device 145 develops the electrostatic latent image, rendering the electrostatic latent image visible as a toner image. Thus, the toner image is formed on the surface of the photoconductor 142.

The primary-transfer high-voltage power supply 149 supplies high-voltage electric power, thereby generating and applying a high voltage to the primary transfer roller 146. The primary transfer roller 146 primarily transfers the toner image from the surface of the photoconductor 142 onto the intermediate belt 147. A secondary transfer device secondarily transfers the toner image from the intermediate belt 147 onto a recording medium. Thereafter, a fixing device heats and fixes the toner image onto the recording medium. Thus, the toner image is formed on the recording medium.

Note that the recording medium described herein is general plain paper. However, various kinds of recording media are available in the present embodiment. For example, coated paper, label paper, an overhead projector sheet, a film, or a flexible thin plate may be used as a recording medium. In the present example illustrated in FIG. 3, the neutralizer 148 is disposed in the image forming device 140. The neutralizer 148 removes charges from the surface of the photoconductor 142. Thereafter, the charging roller 143 charges the surface of the photoconductor 142. In the case of color printing, four similar transfer cleaning devices or four image forming devices 140 may be arranged side by side to primarily transfer four colors of toner images, respectively, onto the intermediate belt 147. Thereafter, the secondary transfer device secondarily transfers the four colors of toner images onto a recording medium as a composite color toner image. The fixing device then fixes the composite color toner image onto the recording medium.

Note that FIG. 3 illustrates a non-contact charging configuration in which the charging roller 143 is apart from the photoconductor 142. Alternatively, a contact charging configuration may be applicable in which the charging roller 143 contacts the photoconductor 142.

Figure 6:
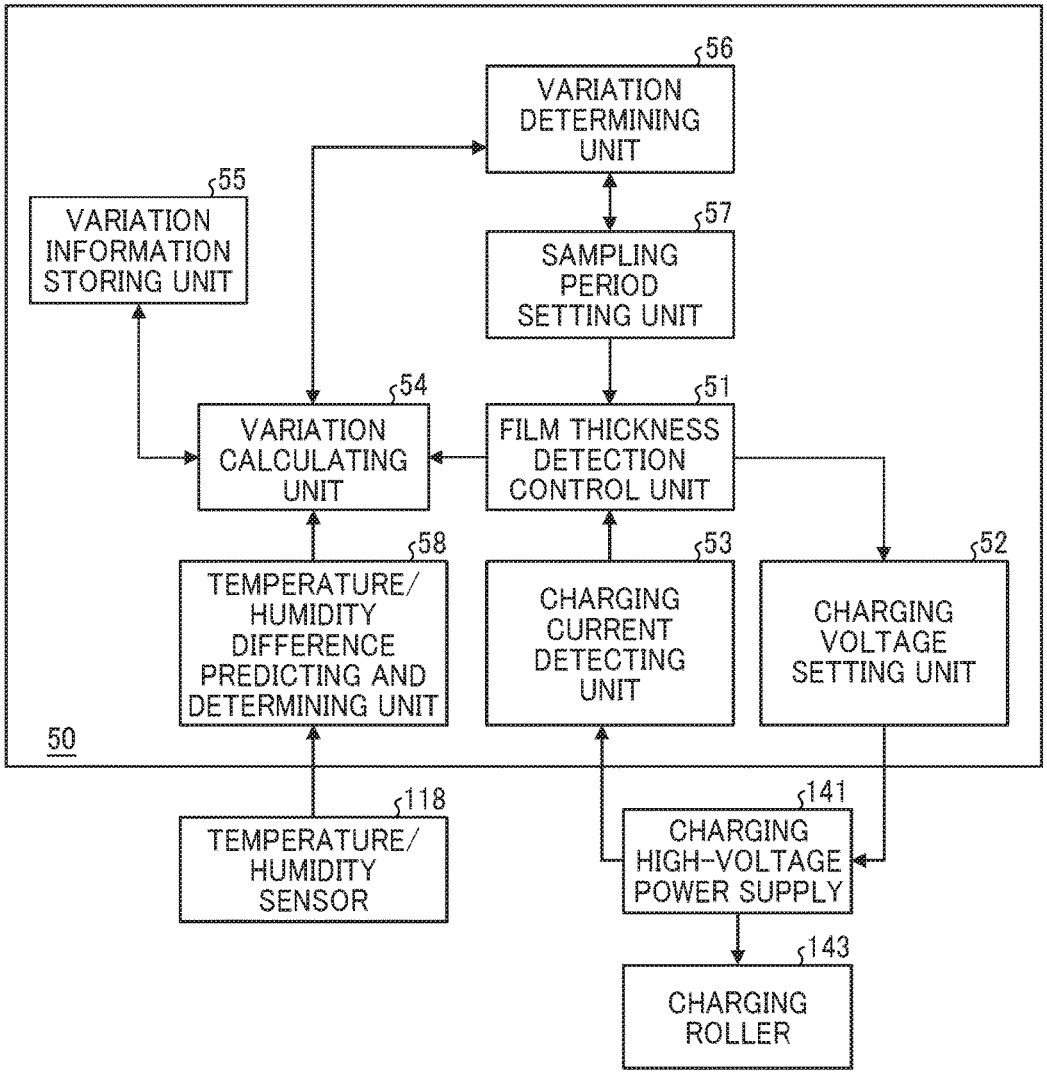
FIG. 6 is a functional block diagram illustrating a functional configuration of a control unit that executes the film thickness detection control.

In the MFP 100, a control unit 50 illustrated in FIG. 6 detects a charging current corresponding to a charging voltage that the charging high-voltage power supply 141 applies to the photoconductor 142 via the charging roller 143. Based on the charging current thus detected, the control unit 50 detects a film thickness of the photoconductor 142. The charging high-voltage power supply 141 is provided with, e.g., a constant voltage circuit as a voltage control system. With the circuit, the charging high-voltage power supply 141 outputs a given charging voltage according to a duty cycle of a pulse-width modulation (PWM) signal set by the control unit 50. In addition, the charging high-voltage power supply 141 is provided with a detector that detects a direct current (DC) flowing to a load (i.e., the charging roller 143). The control unit 50 detects a value of the DC (or a DC value) detected by the detector, thereby detecting the film thickness of the photoconductor 142. Thus, the film thickness detection is controlled. Note that a detailed description of the control unit 50 is deferred.

Generally, in a contact DC charging system in which the charging roller 143 contacts the photoconductor 142 to apply a DC voltage (or DC high voltage) as a charging voltage to the photoconductor 142, a relationship or ratio of a surface potential of the photoconductor 142 to the DC high voltage that is applied is 1:1. Accordingly, the surface potential of the photoconductor 142 is controllable by adjusting the magnitude of the charging voltage that is applied. That is, the charging voltage adjustment controls a charging status of the photoconductor 142, which has an influence on the image forming process. On the other hand, as the photoconductor 142 is rotated for each use, a surface layer of the photoconductor 142 is scraped off. As a consequence, the relationship between the DC high voltage applied to the charging roller 143 and the surface potential of the photoconductor 142 changes.

In order to keep the surface potential of the photoconductor 142 at a target value, an appropriate DC high voltage is to be applied according to a scraped amount of the photoconductor 142. Generally, a photoconductor having a film scraped by more than a certain value is incapable of holding electric charges on the surface of the photoconductor, thereby remarkably degrading the charging performance. The photoconductor in such a state might not be charged, resulting in replacement of the photoconductor.

In order to keep the surface potential of the photoconductor 142 constant against abrasion of the film of the photoconductor 142, the DC high voltage that is applied to the charging roller 143 is to be controlled based on the film thickness of the photoconductor 142 in the contact DC charging system. In addition, the film thickness of the photoconductor 142 is to be correctly acknowledged to determine the life of the photoconductor 142.

A scraped film amount of a photoconductor may be predicted from the number of rotations (or traveled distance) of the photoconductor. However, the film thickness of the photoconductor based on such prediction might be significantly different from an actual film thickness of the photoconductor, due to the usage environment of an MFP including the photoconductor and variations in parts constructing a photoconductor unit.

One approach to such a situation involves measuring the film thickness of the photoconductor 142 from the gradient of "output voltage from the charging high-voltage power supply 141—current characteristics" (i.e., "charging voltage-charging current characteristics"). In such measurement, "sampling" is performed to detect charging current values at given points on the surface of the photoconductor 142. The "sampling" is to detect the charging current a plurality of times for a certain period (e.g., one rotation of the photoconductor 142). A charging current value is determined by use of an average value and maximum and minimum values obtained by the sampling.

As described above, a photoconductor may be partially worn by long use. Sampling of a partially worn photoconductor for one rotation of the photoconductor may result in relatively large fluctuations in charging current value, hampering acquisition of a correct sampling result. Generally, the surface potential of a relatively new photoconductor can be kept at an optimum value with a relatively small charging current value, which fluctuates in a relatively small range. By contrast, a constant surface potential of a photoconductor abraded or partially worn by long use may be kept with a relatively large charging current value, which fluctuates in a relatively large range. In order to obtain more accurate maximum value, minimum value, and average value from detected charging current values, the sampling period may be lengthened. That is, the number of rotations of the photoconductor is increased for a film thickness detection control. For example, the sampling period is lengthened to several rotations of the photoconductor.

In a case in which the partial wear of the photoconductor hampers correct sampling of fluctuations in charging current, the sampling period may be lengthened. For example, if a general sampling period is one rotation, the sampling period is lengthened to two rotations. Lengthening the sampling period reduces the difference between a sampled current value and an actual current value. For example, the photoconductor 142 has a diameter of about 30 mm and a rotational speed of about 292 mm/s. The charging current is sampled per 10 ms. In this case, when the photoconductor 142 is rotated two times, sampling is executed for a period of "10 ms×N" in the first rotation, where N represents the number of sampling or detecting the charging current. Note that, since the photoconductor 142 having a circumference of about 30 πmm rotates at a speed of about 292 mm/s, one rotation of the photoconductor 142 takes about 323 ms. As the sampling is executed per 10 ms, the sampling number N is 32. In the second rotation, the sampling is executed for a period of "10 ms×N+3 ms", because the phase is shifted by the remainder from the first rotation. Specifically, in the first rotation, 323 ms is not exactly divided by 10 ms and the remainder is 3 ms. Thus, the MFP 100 samples the charging current during two rotations of the photoconductor 142 to calculate the average value and the maximum and minimum values of the charging current, thereby reducing the variation.

Variations in detected charging current flowing to the photoconductor 142 changes depending on the sampling period and the sampling cycle. The sampling period herein refers to the number of rotations of the photoconductor 142 subjected to the sampling. On the other hand, the sampling cycle is an interval (e.g., 10-ms intervals) at which the sampling is performed. For example, each of Tables 1 and 2 below illustrates a relationship between the number of rotation of the photoconductor 142 and variations.

TABLE 1

| | VARIATIONS [μA] | |
|---|---|---|
| | σ | 3σ |
| 0.5 ROTATION | 0.343637 | 1.030912 |
| 1 ROTATION | 0.23223 | 0.696689 |
| 2 ROTATIONS | 0.159293 | 0.477878 |
| 3 ROTATIONS | 0.115659 | 0.346978 |

TABLE 2

| | VARIATIONS [μA] | |
|---|---|---|
| | σ | 3σ |
| 0.5 ROTATION | 0.546374 | 1.639121 |
| 1 ROTATION | 0.371313 | 1.113938 |
| 2 ROTATIONS | 0.255468 | 0.766405 |
| 3 ROTATIONS | 0.148654 | 0.445961 |

Table 1 illustrates a case in which the sampling cycle is 10 ms. On the other hand, Table 2 illustrates a case in which the sampling cycle is 20 ms. Data illustrated in Tables 1 and 2 indicate the degree of variations in charging current for each sampling period, specifically, half a rotation, one rotation, two rotations, and three rotations (i.e., 0.5 rotation, 1 rotation, 2 rotations, and 3 rotations). 60 μAv is a median value of the charging current flowing to the photoconductor 142. The sampling cycle is changed as described above between the two cases: Table 1 for the case of 10 ms and Table 2 for the case of 20 ms.

As is apparent from Tables 1 and 2, the longer the sampling period is, and the shorter the sampling cycle is, the smaller the variations in detected charging current are. However, lengthening the sampling period also lengthening the time taken for the film thickness detection control.

Hence, according to the present embodiment, the MFP 100 executes a film thickness detection control while setting the sampling period for two rotations of the photoconductor 142 when determining that the film thickness detection accuracy varies widely. Note that a threshold for determining a variation in film thickness detection accuracy is determined based on fluctuations in charging current value (e.g., difference between maximum and minimum values), variations in past results of film thickness detection control, and prediction from the linear velocity, environment information, and a current measured film thickness of the photoconductor 142.

Figure 4:
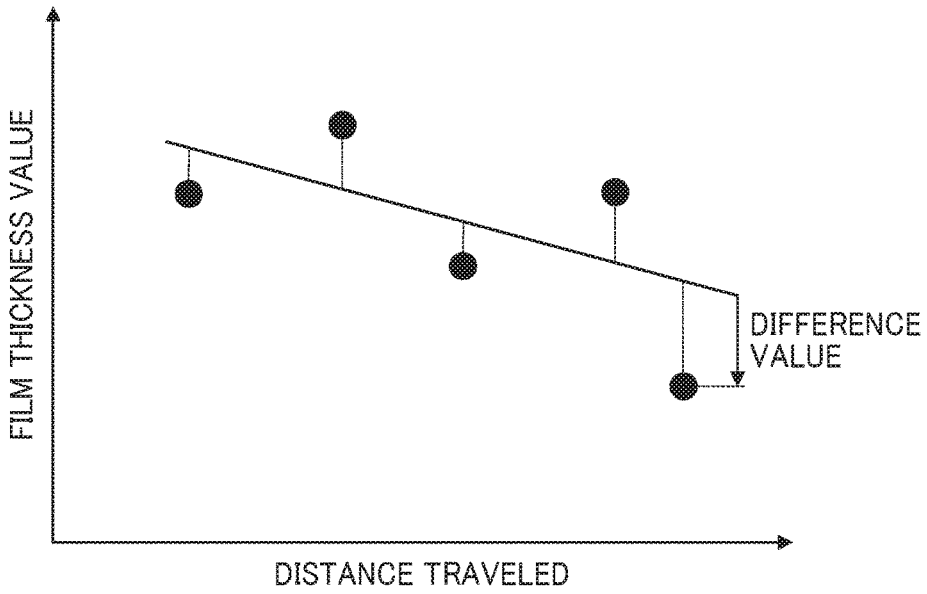
FIG. 4 is a graph illustrating a correlation between a usage amount and a film thickness of a photoconductor on film thickness detection control according to an embodiment of the present disclosure.

Referring now to FIG. 4, a description is given of how to determine a variation in detected film thickness.

FIG. 4 is a graph illustrating a correlation between a usage amount and a film thickness of the photoconductor 142.

As illustrated in FIG. 4, the film thickness value decreases as the usage amount of the photoconductor 142 (i.e., distance traveled by the photoconductor 142) increases. In addition, as the distance traveled by the photoconductor 142 increases, the difference between a film thickness detected on the film thickness detection control and an actual film thickness increases. That is, the difference value between a charging current value detected on the film thickness detection control and an actual charging current value increases. Hence, upon execution of the film thickness detection control, the degree of fluctuations in charging current is predicted from the degree of variations in past several results of film thickness detection control. Thus, the variation in detected charging current is predicted. With such prediction, an allowable degree of variation in charging current on film thickness detection can be determined.

Fluctuations in charging current may be calculated from the magnitude of variation (i.e., the difference between maximum and minimum values) in charging current sampled upon execution of the film thickness detection control.

The magnitude of fluctuations may be predicted from, e.g., the magnitude of the charging current value, the linear velocity of the photoconductor 142, the environment information, which is information on the ambient environment (e.g., temperature) including the photoconductor 142, and the current film thickness value. For example, in a case in which the magnitude of fluctuations is predicted from the linear velocity of the photoconductor 142, a slower linear velocity is predicted to increase the sampling accuracy with respect to fluctuations for one rotation of the photoconductor 142. Alternatively, in a case in which the magnitude of fluctuations is predicted from the environment information, the fluctuations are predicted to decrease in a low-temperature and low-humidity environment (hereinafter referred to as an LL environment), because the charging current value decreases in the LL environment. Alternatively, in a case in which the magnitude of fluctuations is predicted from the current film thickness value, the fluctuations are predicted to increase as the film thickness is thinner, because a thinner film thickness increases the charging current value. In addition, since a thinner film thickness likely to cause partial wear, the fluctuations increase.

Based on the tendencies described above, the degree of variation in detected film thickness can be determined.

Figure 5:
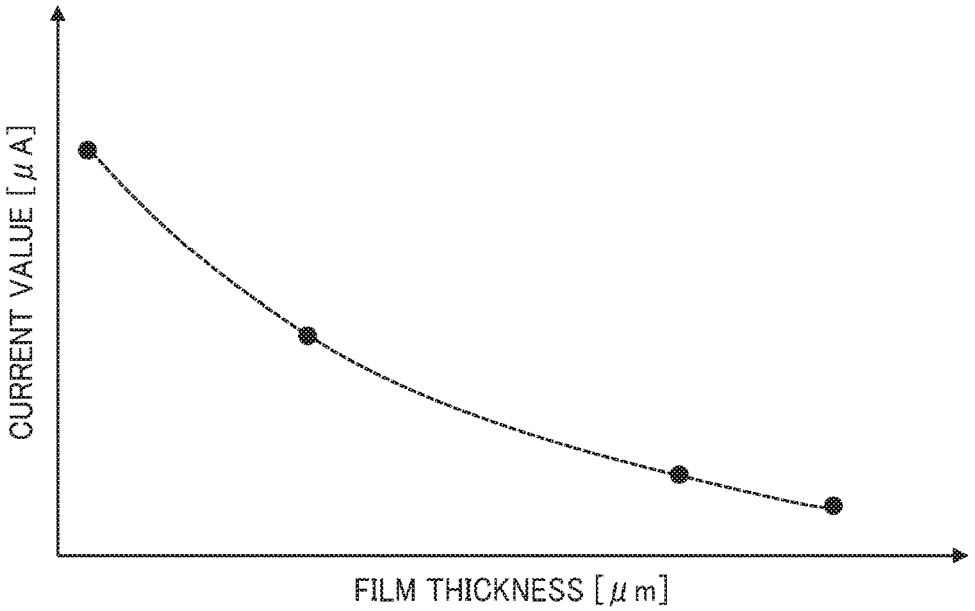
FIG. 5 is a graph illustrating a correlation between photoconductor film thickness and charging current value on the film thickness detection control.

Referring now to FIG. 5, a description is given of how to determine a threshold for determining the magnitude of variation.

FIG. 5 is a graph illustrating a relationship between photoconductor film thickness and charging current value.

As illustrated in FIG. 5, a change amount (i.e., a gradient) of the charging current value increases as the film thickness decreases. That is, how much the variation in sampled charging current value influences the accuracy of detected film thickness depends on the film thickness then. Hence, the MFP 100 according to the present embodiment holds sampling period setting threshold data having data structure exemplified in Table 3, so as to use the sampling period setting threshold data in the control unit 50 described below. Upon the film thickness detection control, the control unit 50 configures the threshold for determining the sampling period according to the variation in charging current value, based on the data exemplified in Table 3. The data exemplified in Table 3 includes thresholds of the charging current fluctuations to set an influence of ±1 μm on the film thickness.

TABLE 3

| FILM THICKNESS | CURRENT FLUCTUATION THRESHOLD AT AN INFLUENCE OF ±1 μm ON FILM THICKNESS |
|---|---|
| AROUND 30 μm | 1.53 |
| AROUND 20 μm | 4.37 |
| AROUND 15 μm | 7.05 |

Referring now to FIG. 6, a description is given of a functional configuration of the control unit 50 that executes the film thickness detection control according to the present embodiment.

FIG. 6 is a functional block diagram illustrating the functional configuration of the control unit 50 included in the MFP 100 according to the present embodiment.

The control unit 50 is implemented by the first CPU 111 executing a control program stored in the first ROM 112 in the hardware configuration of the MFP 100.

The control unit 50 includes a film thickness detection control unit 51, a charging voltage setting unit 52, a charging current detecting unit 53, a variation calculating unit 54, a variation information storing unit 55, a variation determining unit 56, a sampling period setting unit 57, and a temperature/humidity difference predicting and determining unit 58.

In order to obtain the "charging voltage-charging current characteristics" to detect the film thickness of the photoconductor 142, the film thickness detection control unit 51 applies a plurality of charging voltages having different sizes and obtains a charging current corresponding to each of the plurality of charging voltages. To achieve this, the film thickness detection control unit 51 outputs, to the charging voltage setting unit 52, a PWM signal for setting a charging voltage value. With a plurality of PWM signals having different duty cycles, the charging voltage setting unit 52 sets different charging voltage values. The film thickness detection control unit 51 executes the film thickness detection. Specifically, the film thickness detection control unit 51 detects a charging current to detect a film thickness of a surface of the photoconductor 142. The film thickness detection control unit 51 changes a period of time during which the film thickness detection control unit 51 transmits the PWM signal, according to a sampling period set by the sampling period setting unit 57. The "sampling period" herein refers to the number of rotations of the photoconductor 142. In addition, the film thickness detection control unit 51 notifies the variation calculating unit 54 of charging current values detected for a given sampling period.

The charging voltage setting unit 52 receives the PWM signal from the film thickness detection control unit 51. According to the duty cycle of the PWM signal, the charging voltage setting unit 52 sets, as an output value to the charging high-voltage power supply 141, a value of a DC high voltage that the charging high-voltage power supply 141 applies to the charging roller 143. The charging high-voltage power supply 141 applies the DC high voltage to the charging roller 143 based on the output value set by the charging voltage setting unit 52.

The charging current detecting unit 53 detects, from the charging high-voltage power supply 141, charging currents in the charging roller 143 to which a plurality of different charging voltages set by the charging voltage setting unit 52 is applied. Then, the charging current detecting unit 53 notifies the film thickness detection control unit 51 of values of the charging currents thus detected. Thus, the film thickness detection control unit 51 outputs PWM signals of a plurality of different duty cycles to obtain a combination of the charging current value and the charging voltage value corresponding to each of the PWM signals. In short, the film thickness detection control unit 51 obtains the "charging voltage-charging current characteristics". Although the sampling period is set according to the degree of variation in the "charging voltage-charging current characteristics" obtained in the past, the film thickness detection control unit 51 accurately detects the film thickness of the photoconductor 142 based on the gradient of the latest "charging voltage-charging current characteristics".

The variation calculating unit 54 calculates a variation in charging current sampled or detected within a given sampling period by the film thickness detection control unit 51. For example, the variation calculating unit 54 calculates an average value of charging current values detected within the given sampling period. Then, the variation calculating unit 54 notifies the variation information storing unit 55 and the variation determining unit 56 of the average value thus calculated. The variation calculating unit 54 also specifies a maximum value and a minimum value of the charging current values to calculate a difference value between the maximum value and the minimum value. The variation calculating unit 54 then notifies the variation determining unit 56 of the difference value as a variation.

The variation calculating unit 54 may calculate the variation in a way other than the way described above. For example, the variation calculating unit 54 may read past sampling results or past detection results from the variation information storing unit 55 to calculate the average value and the difference value between the maximum and minimum values. Alternatively, the variation calculating unit 54 may calculate the average value by a least square method. Alternatively, the variation calculating unit 54 may predict the variation from the sampling result by use of a linear velocity during execution of the film thickness detection control, the environment information, or the like.

The variation information storing unit 55 stores the variation calculated by the variation calculating unit 54. The variation calculating unit 54 uses a past variation stored in the variation information storing unit 55 to calculate variation.

The variation determining unit 56 compares the variation calculated by the variation calculating unit 54 with a threshold to determine whether the variation is greater than the threshold. In other words, the variation calculating unit 54 determines whether the variation is relatively large or whether the variation is relatively small.

When the variation determining unit 56 determines that the variation is relatively large, in other words, when the variation determining unit 56 determines that the variation is greater than the threshold, the sampling period setting unit 57 determines or sets, as "two rotations of the photoconductor 142", for example, a sampling period taken to detect the charging current on the next execution of the film thickness detection control. On the other hand, when the variation determining unit 56 determines that the variation is relatively small, in other words, when the variation determining unit 56 determines that the variation is not greater than the threshold, the sampling period setting unit 57 determines or sets the sampling period as "one rotation of the photoconductor 142", for example.

The temperature/humidity difference predicting and determining unit 58 predicts a temperature difference between temperature and humidity acquired from the temperature/humidity sensor 118 and a temperature in the vicinity of the charging roller 143. Then, the temperature/humidity difference predicting and determining unit 58 determines whether the temperature difference thus predicted is greater than a target temperature difference for securing the accuracy of the film thickness detection control. The temperature/humidity difference predicting and determining unit 58 notifies the variation calculating unit 54 of the determination as environmental information.

Figure 7:
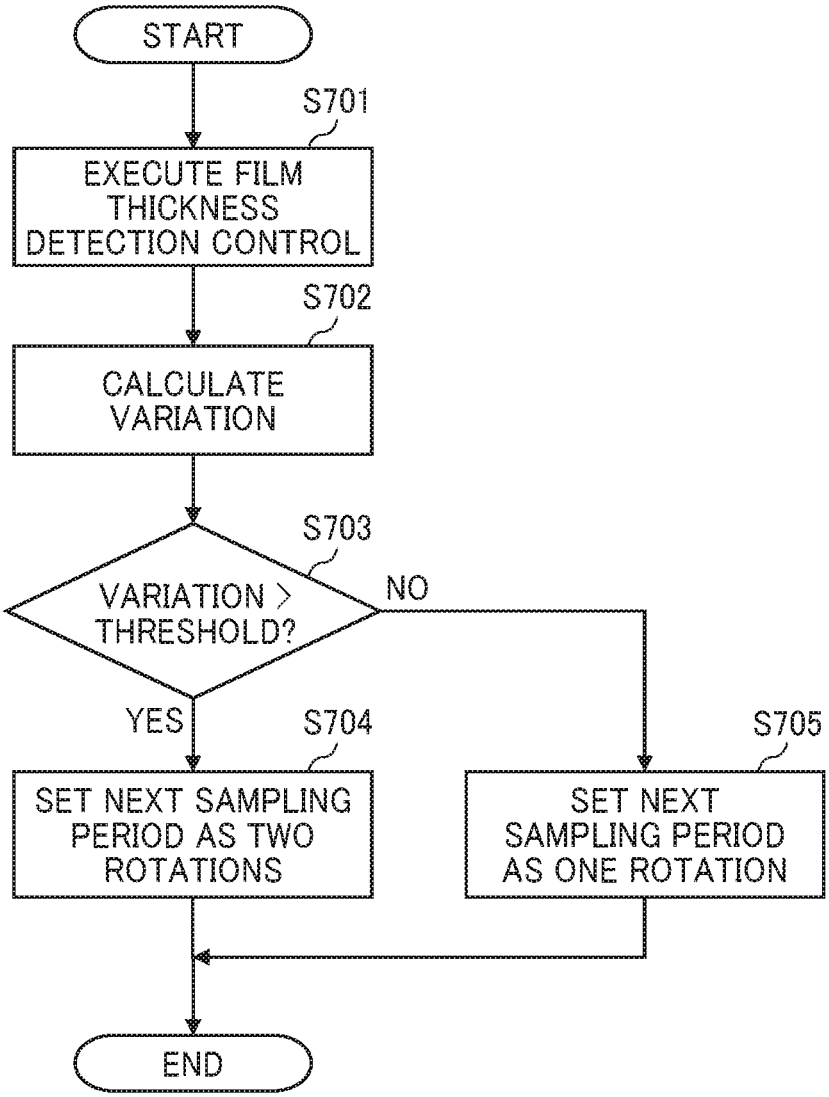
FIG. 7 is a flowchart illustrating an example of timing for executing the film thickness detection control.

Referring now to FIG. 7, a description is given of a flow of controlling the sampling period of the film thickness detection control executed by the control unit 50 in the MFP 100 according to the present embodiment.

FIG. 7 is a flowchart illustrating an example of timing for executing the film thickness detection control.

FIG. 7 illustrates, as a control method performed by the MFP 100 of the present embodiment, an example of a process of setting, according to fluctuations (or variations) in detected film thickness, the next sampling period for sampling charging current on the film thickness detection that the film thickness detection control unit 51 executes to detect the film thickness of the photoconductor 142.

Initially, in step S701, the control unit 50 executes a film thickness detection control. Specifically, based on a sampling period set by the sampling period setting unit 57 in previous processing, the film thickness detection control unit 51 detects a charging current, thereby detecting a film thickness of the photoconductor 142.

In step S702, the control unit 50 specifies, e.g., a maximum value and a minimum value of charging current values acquired for the sampling period in S701, and calculates, as a variation, a difference value between the maximum value and minimum value.

In step S703, the control unit 50 specifies a variation threshold for the film thickness detected in step S701 to compare the difference value (i.e., variation) calculated in step S702 with the variation threshold. Note that the variation threshold is given for each film thickness as illustrated in Table 3. In short, the control unit 50 determines whether the difference value (i.e., variation) is greater than the variation threshold in step S703.

When the control unit 50 determines that the difference value (i.e., variation) is greater than the variation threshold (YES in step S703), the control unit 50 (more specifically, the sampling period setting unit 57) sets the sampling period for sampling charging current on the next film thickness detection control as "two rotations of the photoconductor 142" in step S704.

On the other hand, when the control unit 50 determines that the difference value (i.e., variation) is not greater than the variation threshold (NO in step S703), the control unit 50 (more specifically, the sampling period setting unit 57) sets the sampling period for sampling charging current on the next film thickness detection control as "one rotation of the photoconductor 142" in step S705.

As described above, in order to accurately detect the film thickness of the photoconductor 142, the MFP 100 according to the present embodiment changes a period of time for sampling the charging current (i.e., the sampling period), according to the magnitude of fluctuation (or variation) in the charging current. Such a change addresses a decrease in accuracy of a detected film thickness resulting from a fixed sampling period in which the charging current widely varies due to partial wear of the film thickness of a photoconductor. Thus, the MFP 100 according to the present embodiment enhances the film thickness detection accuracy.

Note that, instead of using a result of sampling, in a given sampling period, the charging current detected in step S701, the control unit 50 may predict the degree of variation in current sampled value (i.e., charging current value) from the variation in charging current value acquired on a past film thickness detection control, to calculate the variation in step S702. Accordingly, regardless of the sampling cycle, the variation in measurement of film thickness is accurately acknowledged.

In addition, as described above, the control unit 50 calculates the variation from the magnitude of fluctuation (i.e., the difference value between the maximum and minimum values) in the charging current detected in step S701 within the given sampling period. Then, the control unit 50 determines the next sampling period according to the variation thus calculated. In short, the control unit 50 sets a sampling period according to a measured value to enhance the accuracy of the film thickness detection control.

With respect to the charging current detected in step S701, the control unit 50 may predict the magnitude of current fluctuations caused by partial wear from the charging output, the linear velocity, the environment, and the current film thickness value. For example, the slower the linear velocity is, the higher the sampling accuracy is with respect to the variation for one rotation of the photoconductor 142. In the LL environment, the charging current decreases, and therefore, the fluctuations decrease. In a case in which the extent of wear of the film thickness is predictable beforehand from the number of uses of the photoconductor 142 (or the number of printed sheets), the threshold for determining the variation is changeable according to the relationship between the film thickness and the current value. Specifically, the thinner the film thickness is, the greater the current value and the fluctuations are. These values are settable as appropriate based on the calculated variations and sampled values stored in the variation information storing unit 55.

According to the embodiments, the image forming apparatus reduces the control time related to film thickness detection while precisely detecting the film thickness of the photoconductor.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. An image forming apparatus comprising:

a photoconductor;

a power supply configured to apply a charging voltage to the photoconductor; and circuitry configured to:

control film thickness detection of detecting a charging current corresponding to the charging voltage to detect a film thickness of a surface of the photoconductor;

determine a sampling period taken to detect the charging current;

calculate a variation in the charging current detected; and determine whether the variation is greater than a threshold, the circuitry being configured to:

determine the sampling period according to a determination result as to whether the variation is greater than the threshold; and sample the charging current for the sampling period determined, on a subsequent film thickness detection control.

2. The image forming apparatus according to claim 1, further comprising a memory that is configured to store information including a past detection result of the charging current and a past variation in the charging current, wherein the circuitry is configured to calculate the variation with a current charging current detected and the information stored in the memory.

3. The image forming apparatus according to claim 1, wherein the circuitry is configured to calculate the variation based on an average value of the charging current sampled.

4. The image forming apparatus according to claim 1, wherein the circuitry is configured to calculate the variation based on a difference value between a maximum value and a minimum value of the charging current sampled.

5. The image forming apparatus according to claim 1, wherein the circuitry is configured to determine the threshold based on the film thickness detected on the film thickness detection.

6. The image forming apparatus according to claim 1, wherein the circuitry is configured to determine the threshold based on environment information including temperature and humidity information.

7. A control method employed by an image forming apparatus that includes a photoconductor, the method comprising:

controlling film thickness detection of detecting a charging current corresponding to a charging voltage applied to the photoconductor, to detect a film thickness of a surface of the photoconductor;

first determining a sampling period taken to detect the charging current;

calculating a variation in the charging current detected; and second determining whether the variation is greater than a threshold, the first determining including determining the sampling period according to a determination result as to whether the variation is greater than the threshold, the controlling including sampling the charging current for the sampling period determined, on a subsequent film thickness detection control.

8. The control method according to claim 7, further comprising storing, in a memory, information including a past detection result of the charging current and a past variation in the charging current, wherein the calculating includes calculating the variation with a current charging current detected and the information stored in the memory.

9. The control method according to claim 7, wherein the calculating includes calculating the variation based on an average value of the charging current sampled.

10. The control method according to claim 7, wherein the calculating includes calculating the variation based on a difference value between a maximum value and a minimum value of the charging current sampled.

11. The control method according to claim 7, wherein the second determining includes determining the threshold based on the film thickness detected on the film thickness detection.

12. The control method according to claim 7, wherein the second determining includes determining the threshold based on environment information including temperature and humidity information.

* * * * *